US010675650B2

(12) United States Patent
Liu et al.

(10) Patent No.: US 10,675,650 B2
(45) Date of Patent: Jun. 9, 2020

(54) PROTECTIVE DEVICE FOR SPRAYING OF ALUMINUM ALLOY WHEEL

(71) Applicant: CITIC Dicastal CO., LTD., Qinhuangdao, Hebei (CN)

(72) Inventors: Weidong Liu, Qinhuangdao (CN); Fengyan Liu, Qinhuangdao (CN); Jiandong Guo, Qinhuangdao (CN); Xiaoguang Huang, Qinhuangdao (CN); Bowen Xue, Qinhuangdao (CN); Yao Zheng, Qinhuangdao (CN)

(73) Assignee: CITIC Dicastal CO., LTD, Qinhuangdao, Hebei (CN)

( * ) Notice: Subject to any disclaimer, the term of this patent is extended or adjusted under 35 U.S.C. 154(b) by 151 days.

(21) Appl. No.: 16/113,052

(22) Filed: Aug. 27, 2018

(65) Prior Publication Data

US 2019/0060941 A1 Feb. 28, 2019

(30) Foreign Application Priority Data

Aug. 31, 2017 (CN) ..... 2017 1 0774158

(51) Int. Cl.

| | |
|---|---|
| ***B25B 11/00*** | (2006.01) |
| ***B05B 15/00*** | (2018.01) |
| ***B05B 12/26*** | (2018.01) |
| ***B05B 12/30*** | (2018.01) |

(52) U.S. Cl.

CPC ..... *B05B 15/00* (2013.01); *B05B 12/26* (2018.02); *B05B 12/30* (2018.02)

(58) Field of Classification Search

CPC ..... B25B 11/00; B25B 11/02; B23P 19/00; B23P 11/00; B23Q 1/03; B23Q 1/28; B23Q 3/00; B23Q 3/06

See application file for complete search history.

(56) References Cited

U.S. PATENT DOCUMENTS

| | | | | |
|---|---|---|---|---|
| 6,502,834 | B1 * | 1/2003 | Fukui | B23B 31/201 279/156 |
| 9,562,831 | B2 * | 2/2017 | Bowen | G01M 3/103 |
| 9,878,454 | B1 * | 1/2018 | Zheng | B25J 15/0028 |
| 2012/0156966 | A1 * | 6/2012 | Mulder | B05B 13/0228 451/28 |
| 2016/0141201 | A1 * | 5/2016 | Toyomura | H01L 21/68728 269/55 |
| 2016/0184955 | A1 * | 6/2016 | Xue | B24B 9/04 451/283 |
| 2016/0207174 | A1 * | 7/2016 | Liu | B23Q 3/062 |
| 2017/0182615 | A1 * | 6/2017 | Xue | B24B 9/04 |
| 2017/0348817 | A1 * | 12/2017 | Xue | B24B 5/44 |
| 2018/0001436 | A1 * | 1/2018 | Xue | B24B 5/44 |
| 2018/0200805 | A1 * | 7/2018 | Xue | B23Q 3/062 |
| 2019/0060941 | A1 * | 2/2019 | Liu | B05B 12/26 |
| 2019/0160613 | A1 * | 5/2019 | Liu | B23Q 3/082 |

* cited by examiner

*Primary Examiner* — Lee D Wilson

(74) *Attorney, Agent, or Firm* — Cooper Legal Group, LLC

(57) ABSTRACT

A protective device for spraying of a wheel is mainly composed of a support, a cylinder, a push plate, bases, floating shafts, shaft sleeves, stop screws, copper sleeves, rotatable pins, springs, elastic collars, end covers, flange plates, guards and a mandrel, wherein the bases and the cylinder are fixed on the support, a flange plate is fixed on each base, an output shaft of the cylinder is connected with the push plate, a copper sleeve is enclosed in each base via an elastic collar, an end cover encloses a spring and a floating shaft inside a shaft sleeve, and the spring is connected with the floating shaft and an end cover respectively.

5 Claims, 6 Drawing Sheets

PROTECTIVE DEVICE FOR SPRAYING OF ALUMINUM ALLOY WHEEL

CROSS-REFERENCE TO RELATED APPLICATIONS

The present application claims benefit of Chinese Patent Application No. 201710774158.8, filed on Aug. 31, 2017, the contents of which are hereby incorporated by reference in its entirety.

BACKGROUND

In the automotive wheel production industry, the spraying process is an important factor affecting the appearance and safety of the wheel. According to the requirements of the automobile manufacturer, paint is not allowed at the matching part of a wheel bolt hole and a mounting bolt. The wheel manufacturer usually uses a bolt hole guard to achieve the aforesaid function. However, the gap between the guard and the bolt hole, leads the paint to be sprayed on the wheel bolt hole, on which paint is not allowed. How to effectively protect the part of the wheel that paint is not allowed on is a problem that the wheel manufacturer must to face.

SUMMARY

The present disclosure relates to a device for a wheel spraying process, specifically to a protective device for spraying of an aluminum alloy wheel.

In order to achieve the above object, the technical solution of the present disclosure is:

This embodiment discloses a protective device for spraying of a wheel, which is mainly composed of a support, a cylinder, a push plate, bases, floating shafts, shaft sleeves, stop screws, copper sleeves, rotatable pins, springs, elastic collars, end covers, flange plates, guards and a mandrel, wherein the bases and the cylinder are fixed on the support, a flange plate is fixed on each base, an output shaft of the cylinder is connected with the push plate, a copper sleeve is enclosed in each base via an elastic collar, an end cover encloses a spring and a floating shaft inside a shaft sleeve, the spring is connected with the floating shaft and an end cover respectively, a stop screw is fixed to the side wall of the shaft sleeve and connected to a bottom side vertical slot of the floating shaft, an opening is formed in a side wall of the top of the floating shaft, open slots are uniformly distributed in the upper end face of the end cover, the opening of the floating shaft is in the same direction as the open slots of the end cover via matching of the stop screw and the side vertical slot of the floating shaft, and the floating shafts can move in the vertical direction. The mandrel is fixed on the upper end face of the shaft sleeves, and a rotatable pin is fixed to the side wall of each base, the rotatable pin passes through the copper sleeve and is connected to the shaft sleeve. A spirally rising ring slot is formed in the side wall of each shaft sleeve. After the cylinder is charged with air, the output shaft of the cylinder drives the push plate to move up, the push plate first contacts with the floating shafts and drives the floating shafts to move up, the springs begin to contract, the floating shafts and the shaft sleeves move relatively in the vertical direction, then, the push plate contacts with the shaft sleeves and drives the shaft sleeves and the floating shafts to move up synchronously, and at the same time, the shaft sleeves, the copper sleeves and the end covers rotate up relative to the bases by matching of the rotatable pins and the ring slots of the shaft sleeves. When the cylinder is at the top, bottom step surfaces of the guards are inserted into upper end face open slots of the end covers. After the compressed air is closed, the shaft sleeves and the floating shafts rotate down relative to the bases under the action of gravity by matching of the rotatable pins and the side ring slots of the shaft sleeves, intermediate thin shafts of the guards move to the openings of the floating shafts, and at the same time, the upper end faces of the bottom step surfaces of the guards are caught at the openings of the floating shafts, so that the guards press a bolt hole countersink platform of the wheel.

In an aspect of the present disclosure, provided a protective device for spraying of an aluminum alloy wheel, which is composed of a support, a cylinder, a push plate, bases, floating shafts, shaft sleeves, stop screws, copper sleeves, rotatable pins, springs, elastic collars, end covers, flange plates, guards and a mandrel, wherein the bases and the cylinder are fixed on the support, a flange plate is fixed on each base, an output shaft of the cylinder is connected with the push plate, a copper sleeve is enclosed in each base via an elastic collar, an end cover encloses a spring and a floating shaft inside a shaft sleeve, the spring is connected with the floating shaft and an end cover respectively; a stop screw is fixed to the side wall of the shaft sleeve and connected to a bottom side vertical slot of the floating shaft; the mandrel is fixed on the upper end face of the shaft sleeves, and a rotatable pin is fixed to the side wall of each base, the rotatable pin passes through the copper sleeve and is connected to the shaft sleeve.

In a preferred aspect of the present disclosure, a spirally rising ring slot is formed in the side wall of each shaft sleeve.

In a preferred aspect of the present disclosure, after the cylinder is charged with air, the output shaft of the cylinder drives the push plate to move up, the push plate first contacts the floating shafts and drives the floating shafts to move up, the springs begin to contract, the floating shafts and the shaft sleeves move relatively in the vertical direction; the push plate contacts the shaft sleeves and drives the shaft sleeves and the floating shafts to move up synchronously; the shaft sleeves, the copper sleeves and the end covers rotate up relative to the bases by matching of the rotatable pins and the ring slots of the shaft sleeves.

In a preferred aspect of the present disclosure, when the cylinder is at the top, bottom step surfaces of the guards are inserted into upper end face open slots of the end covers; after the compressed air is closed, the shaft sleeves and the floating shafts rotate down relative to the bases under the action of gravity by matching of the rotatable pins and the side ring slots of the shaft sleeves, intermediate thin shafts of the guards move to the openings of the floating shafts; and at the same time, the upper end faces of the bottom step surfaces of the guards are caught at the openings of the floating shafts, so that the guards press a bolt hole countersink platform of the wheel.

In a preferred aspect of the present disclosure, an opening is in a side wall of the top of a floating shaft, open slots are uniformly distributed in the upper end face of an end cover, the opening of the floating shaft is in the same direction as the open slots of the end cover via matching of a stop screw and a side vertical slot of the floating shaft, and the floating shaft can move in the vertical direction.

Before actual use, the cylinder is charged with air, the output shaft of the cylinder drives the push plate to move up, the push plate first contacts the floating shafts and drives the floating shafts to move up, the springs begin to contract, the floating shafts and the shaft sleeves move relatively in the vertical direction, then, the push plate contacts the shaft sleeves and drives the shaft sleeves and the floating shafts to move up synchronously, at the same time, the shaft sleeves, the copper sleeves and the end covers rotate up relative to the bases by matching of the rotatable pins and the ring slots of the shaft sleeves, and the end covers and the floating shafts are at the highest positions. During the actual use, wheel flange surfaces are fitted to the flange plates in the device of the present disclosure, the mandrel is matched with the center hole of the wheel, bolt holes are respectively aligned with the open slots uniformly distributed in the end faces, the guards are placed into the bolt holes, and the bottom step surfaces of the guards are inserted into the upper end face open slots of the end covers. After the introduction of air to the cylinder is stopped, the shaft sleeves and the floating shafts rotate down relative to the bases under the action of gravity by matching of the rotatable pins and the side ring slots of the shaft sleeves, the openings of the floating shafts rotate to the intermediate thin shafts of the guards, and at the same time, the upper end faces of the bottom step surfaces of the guards are caught at the openings of the floating shafts, so that the guards press on the bolt hole countersink platform of the wheel. So far, the protection of the wheel is completed and spraying begins.

In using, the present disclosure can meet the requirement for on-line turnover of a wheel, and it is ideal in effect, high in efficiency, safe, reliable and high level of automation, and is particularly suitable for mass production on a production line.

BRIEF DESCRIPTION OF DRAWINGS

The embodiments of the present disclosure will be described in detail below in combination with the accompanying drawings, in which:

FIG. 2 is a structure diagram of a floating shaft in the protective device for spraying of a wheel according to the present disclosure, wherein.

FIG. 5 is a structure diagram of a base in the protective device for spraying of a wheel according to the present disclosure, wherein.

LIST OF REFERENCE SYMBOLS

Figure 1:
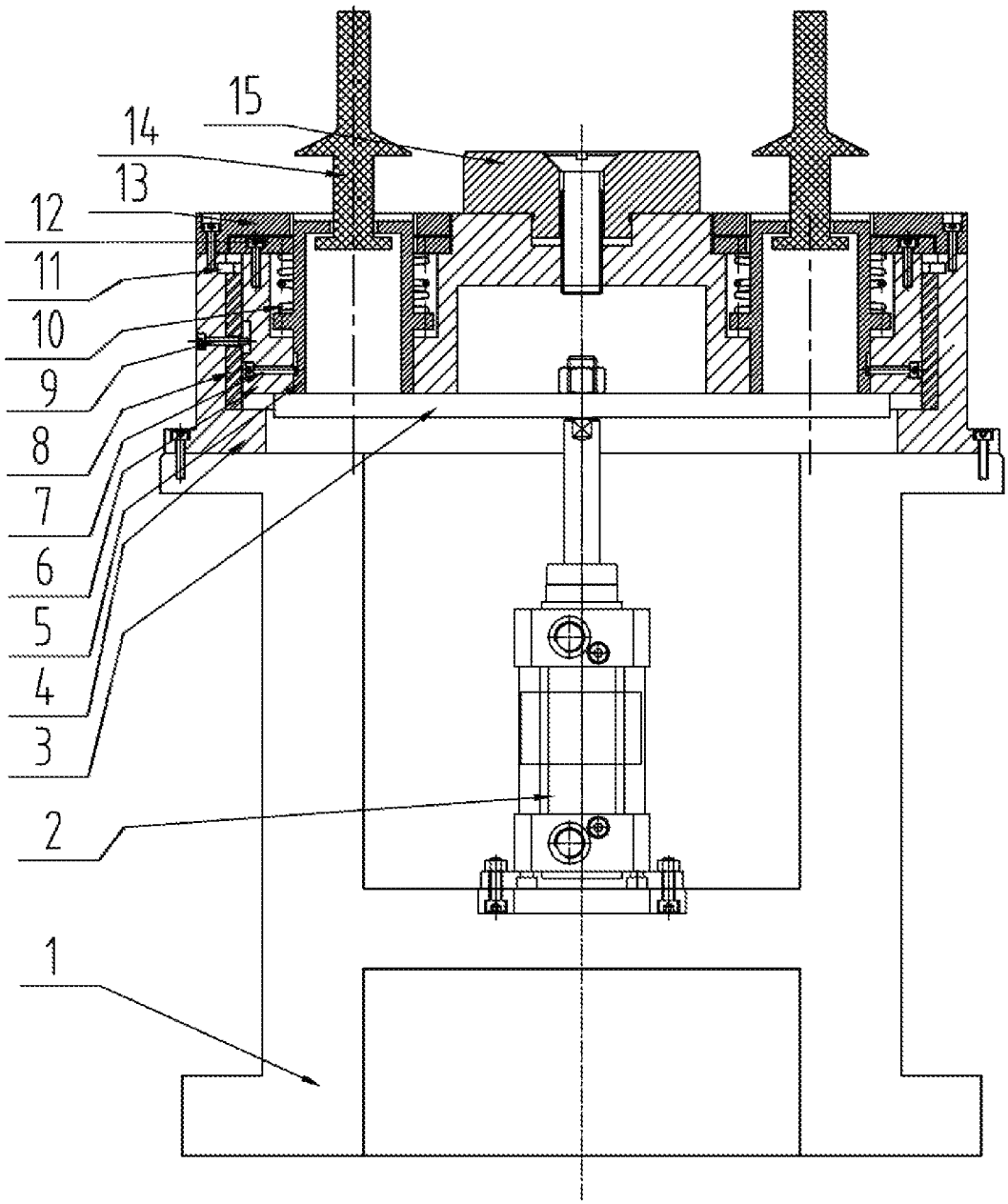
FIG. 1 is a structure diagram of a protective device for spraying of a wheel according to the present disclosure.
Figure 2A:
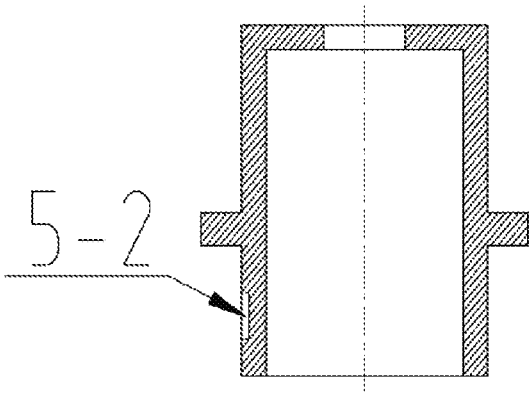
FIG. 2A is a cross-sectional view of the floating shaft in one direction.
Figure 2B:
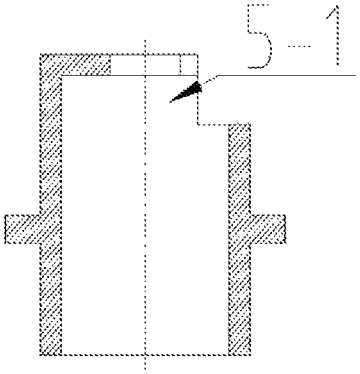
FIG. 2B is a cross-sectional view of the floating shaft in another direction.
Figure 2C:
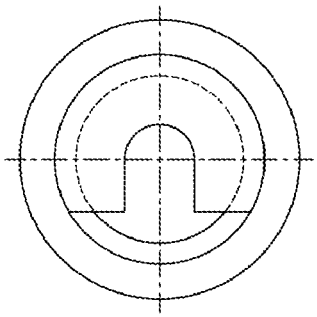
FIG. 2C is a longitudinal sectional view of the floating shaft.
Figure 3:
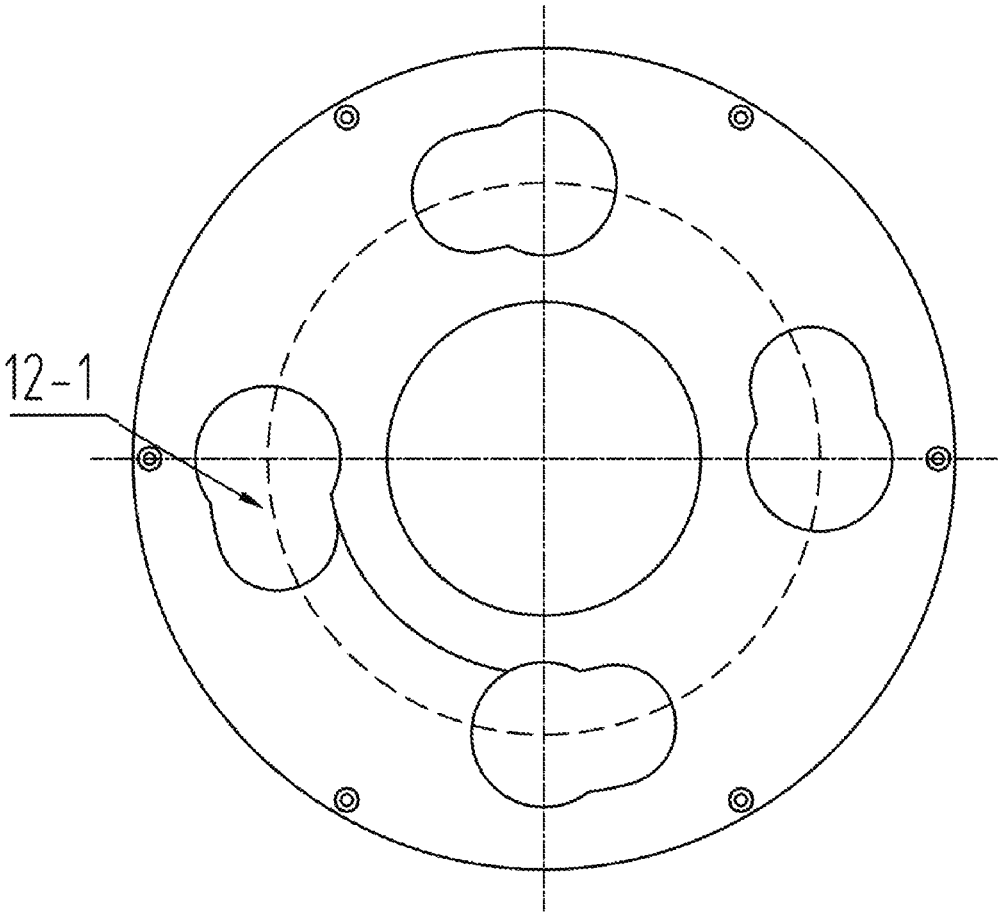
FIG. 3 is a structure diagram of an end cover in the protective device for spraying of a wheel according to the present disclosure.
Figure 4:
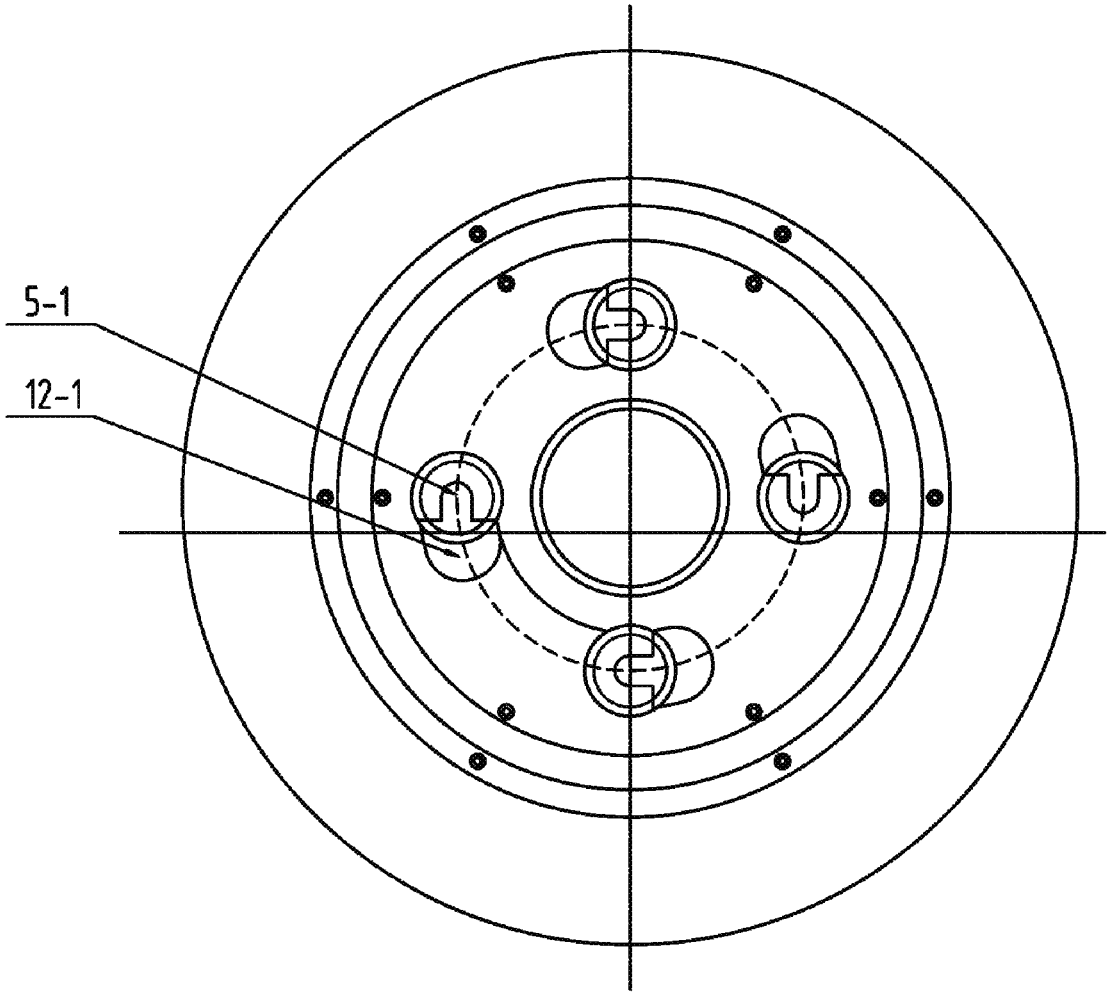
FIG. 4 is a top view of the protective device for spraying of a wheel according to the present disclosure.
Figure 5A:
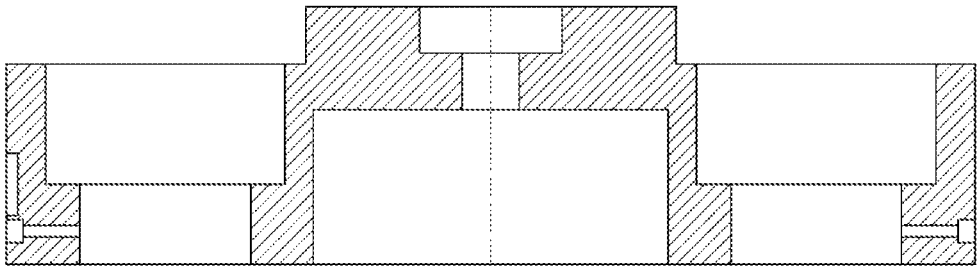
FIG. 5A is a cross-sectional view of the base.
Figure 5B:
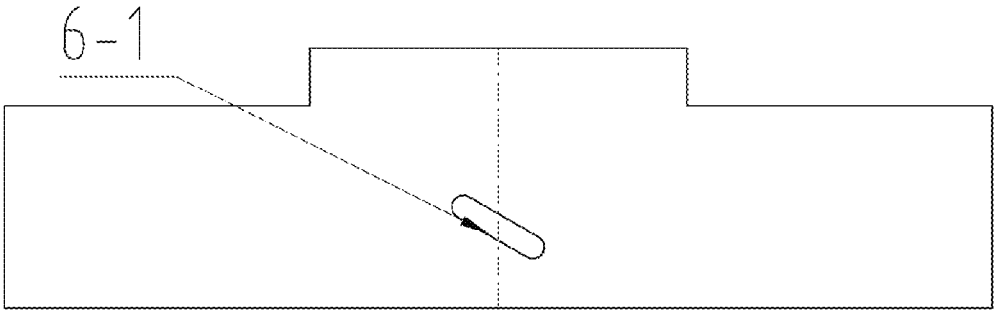
FIG. 5B is a side view of the base.
Figure 6:
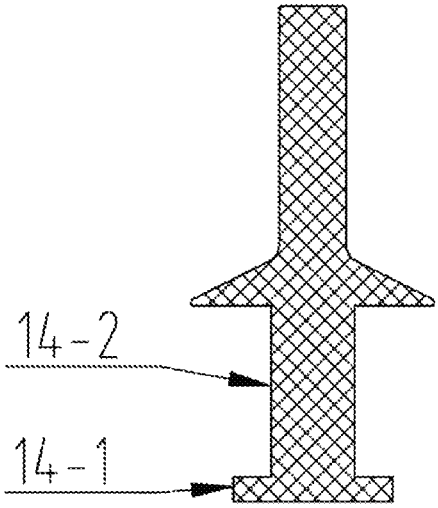
FIG. 6 is a structure diagram of a guard in the protective device for spraying of a wheel according to the present disclosure.
Figure 7:
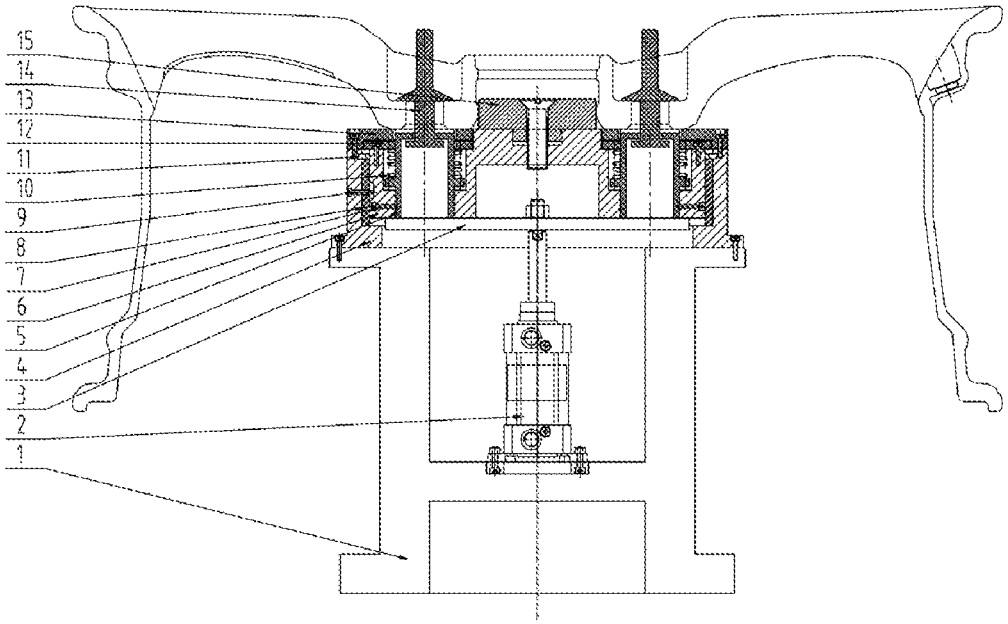
FIG. 7 is a structure diagram when the protective device for spraying of a wheel according to the present disclosure works.

1 support
2 cylinder
3 push plate
4 base
5 floating shaft
6 shaft sleeve
7 stop screw
8 copper sleeve
9 rotatable pin
10 spring
11 elastic collar
12 end cover
13 flange plate
14 guard
15 mandrel
5-1 opening
5-2 side vertical slot
12-1 open slot

DETAILED DESCRIPTION

Embodiment 1

The details and working conditions of the specific device according to the present disclosure will be described in detail below in combination with the drawings.

This embodiment discloses a protective device for spraying of a wheel, which is mainly composed of a support 1, a cylinder 2, a push plate 3, bases 4, floating shafts 5, shaft sleeves 6, stop screws 7, copper sleeves 8, rotatable pins 9, springs 10, elastic collars 11, end covers 12, flange plates 13, guards 14 and a mandrel 15, wherein the bases 4 and the cylinder 2 are fixed on the support 1, a flange plate 13 is fixed on each base 4, an output shaft of the cylinder 2 is connected with the push plate 3, a copper sleeve 8 is enclosed in each base 4 via an elastic collar 11, an end cover 12 encloses a spring 10 and a floating shaft 5 inside a shaft sleeve 6, the spring 10 is connected with the floating shaft 5 and an end cover 12 respectively, a stop screw 7 is fixed to the side wall of the shaft sleeve 6 and connected to a bottom side vertical slot 5-2 of the floating shaft 5, an opening 5-1 is formed in a side wall of the top of the floating shaft 5, open slots 12-1 are uniformly distributed in the upper end face of the end cover 12, the opening 5-1 of the floating shaft 5 is in the same direction as the open slots 12-1 of the end cover 12 via matching of the stop screw and the side vertical slot 5-2 of the floating shaft, and the floating shafts 5 can move in the vertical direction. The mandrel 15 is fixed on the upper end face of the shaft sleeves 6, and a rotatable pin 9 is fixed to the side wall of each base 4, the rotatable pin 9 passes through the copper sleeve 8 and is connected to the shaft sleeve 6. A spirally rising ring slot 6-1 is formed in the side wall of each shaft sleeve 6. After the cylinder 2 is charged with air, the output shaft of the cylinder 2 drives the push plate 3 to move up, the push plate 3 first contacts with the floating shafts 5 and drives the floating shafts 5 to move up, the springs 10 begin to contract, the floating shafts 5 and the shaft sleeves 6 move relatively in the vertical direction, then, the push plate 3 contacts with the shaft sleeves 6 and drives the shaft sleeves 6 and the floating shafts 5 to move up synchronously, and at the same time, the shaft sleeves 6, the copper sleeves 8 and the end covers 12 rotate up relative to the bases 4 by matching of the rotatable pins 9 and the ring slots 6-1 of the shaft sleeves 6. When the cylinder 2 is at the top, bottom step surfaces 14-1 of the guards 14 are inserted into upper end face open slots 12-1 of the end covers 12. After the compressed air is closed, the shaft sleeves 6 and the floating shafts 5 rotate down relative to the bases 4 under the action of gravity by matching of the rotatable pins 9 and the side ring slots 6-1 of the shaft sleeves 6, intermediate thin shafts 14-2 of the guards 14 move to the openings 5-1 of the floating shafts 5, and at the same time, the upper end faces of the bottom step surfaces 14-1 of the guards 14 are caught at the openings 5-1 of the floating shafts 5, so that the guards 14 press a bolt hole countersink platform of the wheel.

Before actual use, the cylinder 2 is charged with air, the output shaft of the cylinder 2 drives the push plate 3 to move up, the push plate 3 first contacts the floating shafts 5 and drives the floating shafts 5 to move up, the springs 10 begin to contract, the floating shafts 5 and the shaft sleeves 6 move relatively in the vertical direction, then, the push plate 3 contacts the shaft sleeves 6 and drives the shaft sleeves 6 and the floating shafts 5 to move up synchronously, at the same time, the shaft sleeves 6, the copper sleeves 8 and the end covers 12 rotate up relative to the bases 4 by matching of the rotatable pins 9 and the ring slots 6-1 of the shaft sleeves 6, and the end covers 12 and the floating shafts 5 are at the highest positions. During the actual use, wheel flange surfaces are fitted to the flange plates 13 in the device of the present disclosure, the mandrel 15 is matched with the center hole of the wheel, bolt holes are respectively aligned with the open slots 12-1 uniformly distributed in the end faces, the guards 14 are placed into the bolt holes, and the bottom step surfaces 14-1 of the guards 14 are inserted into the upper end face open slots 12-1 of the end covers 12. After the introduction of air to the cylinder 2 is stopped, the shaft sleeves 6 and the floating shafts 5 rotate down relative to the bases 4 under the action of gravity by matching of the rotatable pins 9 and the side ring slots 6-1 of the shaft sleeves 6, the openings 5-1 of the floating shafts 5 rotate to the intermediate thin shafts 14-2 of the guards 14, and at the same time, the upper end faces of the bottom step surfaces 14-1 of the guards 14 are caught at the openings 5-1 of the floating shafts 5, so that the guards 14 press on the bolt hole countersink platform of the wheel. So far, the protection of the wheel is completed and spraying begins.

The invention claimed is:

1. A protective device for spraying of an aluminum alloy wheel, being composed of a support, a cylinder, a push plate, bases, floating shafts, shaft sleeves, stop screws, copper sleeves, rotatable pins, springs, elastic collars, end covers, flange plates, guards and a mandrel, wherein the bases and the cylinder are fixed on the support, a flange plate is fixed on each base, an output shaft of the cylinder is connected with the push plate, a copper sleeve is enclosed in each base via an elastic collar, an end cover encloses a spring and a floating shaft inside a shaft sleeve, and the spring is connected with the floating shaft and an end cover respectively; a stop screw is fixed to a side wall of the shaft sleeve and connected to a bottom side vertical slot of the floating shaft; the mandrel is fixed on an upper end face of the shaft sleeves, and a rotatable pin is fixed to a side wall of each base, passes through the copper sleeve and is connected to the shaft sleeve.

2. The protective device according to claim 1, wherein a spirally rising ring slot is formed in the side wall of each shaft sleeve.

3. The protective device according to claim 1, wherein after the cylinder is charged with air, the output shaft of the cylinder drives the push plate to move up, the push plate first contacts the floating shafts and drives the floating shafts to move up, the springs begin to contract, and the floating shafts and the shaft sleeves move relatively in the vertical direction; the push plate contacts the shaft sleeves and is set to drive the shaft sleeves and the floating shafts to move up synchronously; and the shaft sleeves, the copper sleeves and the end covers are set to rotate up relative to the bases by matching of the rotatable pins and the ring slots of the shaft sleeves.

4. The protective device according to claim 1, wherein when the cylinder is at the top, bottom step surfaces of the guards are inserted into upper end face open slots of the end covers; after the compressed air is closed, the shaft sleeves and the floating shafts rotate down relative to the bases under the action of gravity by matching of the rotatable pins and side ring slots of the shaft sleeves, and intermediate thin shafts of the guards move to the openings of the floating shafts; and at the same time, upper end faces of the bottom step surfaces of the guards are set to caught at the openings of the floating shafts, so that the guards press on a bolt hole countersink platform of the wheel.

5. The protective device according to claim 1, wherein, an opening is formed in a side wall of the top of the floating shaft, open slots are uniformly distributed in the upper end face of the end cover, the opening of the floating shaft is in the same direction as the open slots of the end cover via matching of the stop screw and the side vertical slot of the floating shaft, and the floating shaft can move in the vertical direction.

* * * * *